US005531634A

United States Patent [19]

Schott

[11] Patent Number: 5,531,634

[45] Date of Patent: Jul. 2, 1996

[54] METHOD OF USING AN ABRASIVE MATERIAL FOR BLAST CLEANING OF SOLID SURFACES

[76] Inventor: Paul Schott, 66 High St., Perth Amboy, N.J. 08861

[21] Appl. No.: 383,206

[22] Filed: Feb. 3, 1995

[51] Int. Cl.[6] ..... B24B 1/00; B24C 1/00; B24C 7/00

[52] U.S. Cl. ..... 451/39; 451/99; 134/7

[58] Field of Search ..... 15/95; 29/90.01; 134/7; 451/36, 38, 39, 75, 99

[56] References Cited

U.S. PATENT DOCUMENTS

| | | | |
|---|---|---|---|
| 2,710,286 | 6/1955 | Zachariason | 451/39 X |
| 4,878,320 | 11/1989 | Woodson | 451/75 X |
| 5,226,969 | 7/1993 | Watanabe et al. | 134/7 |
| 5,365,702 | 11/1994 | Shank, Jr. | 451/39 X |
| 5,376,157 | 12/1994 | Yam et al. | 451/39 X |
| 5,401,204 | 3/1995 | Shank | 451/39 X |

*Primary Examiner*—Timothy V. Eley
*Attorney, Agent, or Firm*—Ezra Sutton

[57] ABSTRACT

A method for blast cleaning a solid surface using an abrasive composition of calcium carbonate, wherein the abrasive-blasting operation uses blasting apparatus including a blasting pot, a blasting hose and spray nozzle connected to the blasting pot, an air compressor and compressor air lines connected to the blasting pot, and blasting hose and spray nozzle, comprising the steps include filling the blasting pot with an abrasive composition of a coarse, medium, or fine grade of calcium carbonate, selecting a blasting spray nozzle having a specific size, adjusting the media flow valve connected to the blasting pot to set a specific blasting flow rate, setting the air pressure on the compressor air line connected to the spray nozzle, setting the air volume flow rate on the compressor air line, holding the spray nozzle a distance of 6" to 24" away from the surface to be cleaned, and moving said spray nozzle across the surface to be cleaned and wherein the above sequence of steps may be varied.

30 Claims, 4 Drawing Sheets

METHOD OF USING AN ABRASIVE MATERIAL FOR BLAST CLEANING OF SOLID SURFACES

FIELD OF THE INVENTION

The present invention relates to the use of calcium carbonate ($CaCO_3$) as an abrasive cleaning material in an abrasive-blasting operation (also referred to as a sand-blasting operation). This abrasive material of calcium carbonate provides heavy-duty abrasive-blasting and cleaning of cement, steel, masonry, brick, and the like, and the removal of paint and other materials from such surfaces.

BACKGROUND OF THE INVENTION

In present heavy-duty abrasive-blasting and cleaning operations, the normal abrasive materials of choice are usually sand, silica, aluminum oxide ($Al_2O_3$), steel slag, steel shot, and the like. The use of such heavy-duty abrasives is generally too abrasive for a given surface layer of steel, cement, etc., so that the cleaned surface layer shows excessive irregularities of chips and cracks and a choppy non-uniformity of surface smoothness. This type of cleaned surface typically depicts a degree of coarseness and roughness that is normally associated with abrasive blasting of surfaces when using the heavy-duty abrasives previously mentioned. Accordingly, it would be desirable to provide an improved abrasive material that would clean a given surface layer of material without having any deleterious effect to that surface layer. It would also be desirable to provide a cleaned surface that is uniformly smooth and free of pitting or blasting marks from the abrasive material used.

DESCRIPTION OF PRIOR ART

Abrasive cleaning materials and their method of use have been disclosed in the prior art. In particular, the prior art discloses non-conventional abrasive materials as substitutes for the conventional materials of sand, silica, steel shot, etc. For example, U.S. Pat. No. 2,710,286 to R. H. Zachariason discloses the use of abrasive materials for the removal of fluorescent materials from TV screens by directing a jet of gas-abrasive mixture towards the face plate of a cathode ray tube. The abrasive materials used were sodium carbonate and potassium carbonate, among others.

U.S. Pat. No. 3,852,918 to Robert B. Black discloses the use of abrasive materials for dental prophylaxis, in particular. The patent states that it is preferred to employ a relatively soft abrasive, for instance, 30 micron calcium carbonate.

U.S. Pat. No. 4,343,116 to Norman A. Murphy, et al discloses the use of abrasive materials for the process of furnishing glass furnaces. The patent states that undissolved particles of calcium carbonate serve as the particles for the polishing of a lens surface.

U.S. Pat. No. 4,878,320 to Jerry P. Woodson discloses the use of abrasive materials for the removal of paint from an aircraft, fiberglass boat, or the like by using an abrasive feed system that provides a wet or dry blast cleaning process that allows the use of an abrasive, such as sodium bicarbonate.

U.S. Pat. No. 5,083,402 to L. Kirschner, et al discloses the use of abrasive materials to remove coatings of paint from metal and plastic surfaces by using a modified industrial pressure blasting apparatus. The patent discloses using less aggressive abrasives, which include inorganic salts, such as sodium chloride and sodium bicarbonate, which can be used in conventional sand-blasting equipment.

U.S. Pat. No. 5,226,969 to M. Watanabe, et al discloses the use of abrasive materials for the cleaning of a solid surface, such as printed circuit boards. The patent states that the insoluble particles may be particles of abrasives from at least one of the selected group consisting of glass, silicon, alumina, calcium carbonate, and cerium oxide.

The aforementioned prior art patents show that in abrasive-blasting operations, sodium bicarbonate is commonly used, as taught in U.S. Pat. Nos. 4,878,320 and 5,083,402. However, in delicate cleaning operations such as the cleaning of TV cathode ray tubes, teeth, and printed circuit boards, and the polishing of glass lens surfaces, calcium carbonate has been used. Therefore, the prior art does not teach the using of the softer calcium carbonate ($CaCO_3$) in heavy-duty blasting operations, such as preparing cement and steel surfaces for painting and the like. Accordingly, the concept of using the softer calcium carbonate as an abrasive material for heavy-duty type industrial applications is not obvious. Thus, the prior art patents that teach the using of the softer calcium carbonate ($CaCO_3$) for delicate cleaning operations do not render obvious the use of calcium carbonate for heavy-duty abrasive blasting operations.

Accordingly, it is an object of the present invention to provide a method of employing an abrasive material, such as soft calcium carbonate ($CaCO_3$) to be used in heavy-duty abrasive blasting and cleaning of cement structures, brick structures, steel structures, and the like for the removal of paint, grease, grime, rust, etc., from their surfaces.

Another object of the present invention is to provide an abrasive material that is soft, with the ability to clean a surface with a minimal amount of a surface layer being abraded and with no damage to the surface being cleaned.

Another object of the present invention is to provide an abrasive material that is environmentally safe, wherein the calcium carbonate in use is non-toxic and is free of heavy metals, silica, and iron particles and, in some cases, provides a minimal amount of dust production when in use.

It is still another object of the present invention to provide an abrasive material that is worker friendly, such that the user does not need a full air respirator with an air tank but only needs a simple nose and mouth face mask.

A still further object of the present invention is to provide an abrasive material that has no health hazards connected with it when in use.

SUMMARY OF THE INVENTION

The method of using calcium carbonate ($CaCO_3$) as an abrasive material includes using coarse, medium and fine grades of calcium carbonate. The grade used depends upon the type of abrasive blasting needed for the surface material being cleaned, such as wood, brick, or steel, and the profile of surface required. For example, a wood surface having a lacquered finish would be cleaned with a fine grade of calcium carbonate at a reduced (low) pressure and flow rate. A painted steel surface having rust, discoloration, and pitting would be cleaned to a white metal using a coarser grade of calcium carbonate at a relatively higher pressure and higher flow rate, whereas the fine grades are used at low pressure and low flow rate for the cleaning of wood or brick.

The calcium carbonate abrasive material would be used in any standard type of commercially available abrasive-blasting system. The standard abrasive blasting system includes a compressed air or gas source; a pressurized media vessel having standard pressure gauges, pressure regulators, media valves, a media orifice plate, air lines, and media exit lines; and a standard conveying hose with a water-injection nozzle having various nozzle orifice components of different sizes for the spraying of the various grades of calcium carbonate being used.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PREFERRED INVENTION

The use of calcium carbonate ($CaCO_3$) 10, also known as calcite, in the form of the mineral aragonite as an abrasive material provides for numerous heavy-duty abrasive-blasting operations. Calcium carbonate 10, having the following characteristics, is a nuisance particulate that is non-toxic to human contact and breathing. The calcium carbonate 10 is non-combustible and has no fire or explosion hazards associated with its product use. This material is a stable solid and has no hazardous polymerization associated with its use. Calcium carbonate 10, as used in this invention, has a specific gravity (density) average of 2.82 (176.0 lbs/ft$^3$) and a range of 2.71 to 2.93 (169.1 lbs/ft$^3$ to 182.8 lbs/ft$^3$). Calcium carbonate 10 is not soluble in water, and this solid material is odorless, tasteless, and is white in appearance. The particle sizing of the calcium carbonate 10, when used in abrasive-blasting operations 20, regardless to a given particle size gradation, is in the range of a 4 MESH, which is equivalent to a 0.187" or 4.77 mm in particle size diameter to a 200 MESH, which is equivalent to a 0.0029" or 0.074 mm or 74 microns in particle size diameter, having an average particle size diameter of 48 MESH, which is equivalent to 0.0116" or 0.295 mm or 295 microns in particle size width.

The abrasive material hardness for calcium carbonate 10 is in the range of 3.5 MOHS to 4.5 MOHS hardness, with an average MOHS hardness of 4.25. The usage for this range of MOHS hardness of calcium carbonate 10 abrasive material is generally used for fine cleaning and deburring of delicate surfaces, such as electric motors, brick, stone, concrete, or wood; it is also used for removing of paint, varnish, and/or lacquers off of delicate surfaces, such as aircraft, fiberglass boats, fiberglass structures, and the like.

Figure 1:
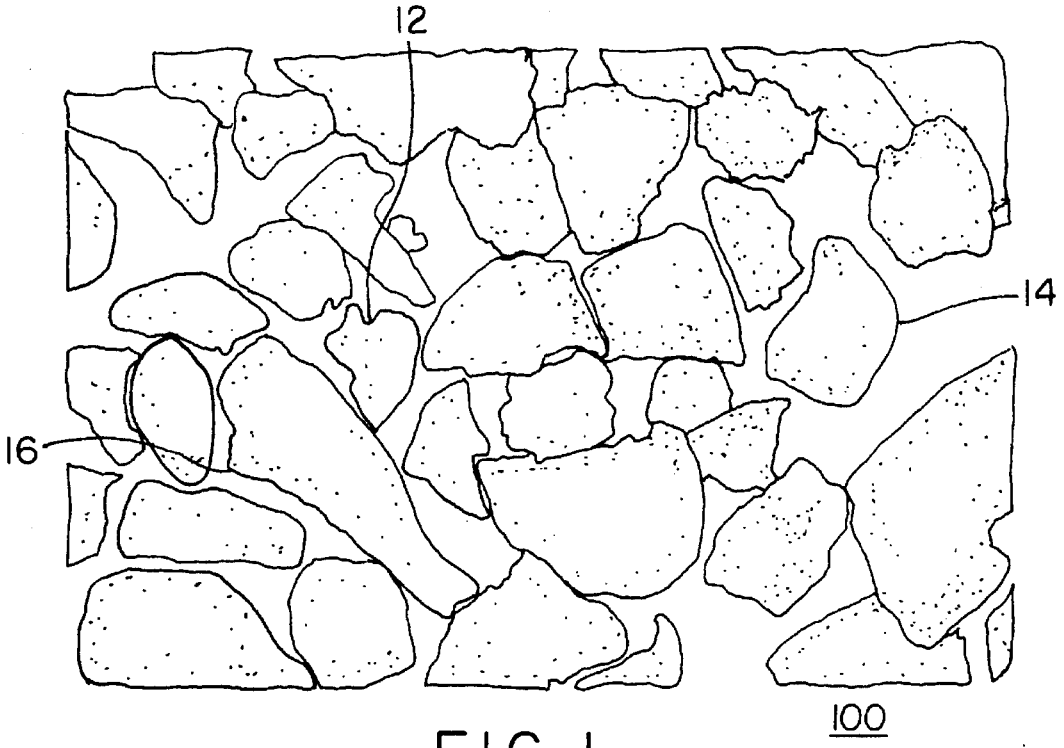
FIG. 1 is a top plan view of the calcium carbonate abrasive of the present invention showing a coarse grade of material at 13.2× magnification.
Figure 2:
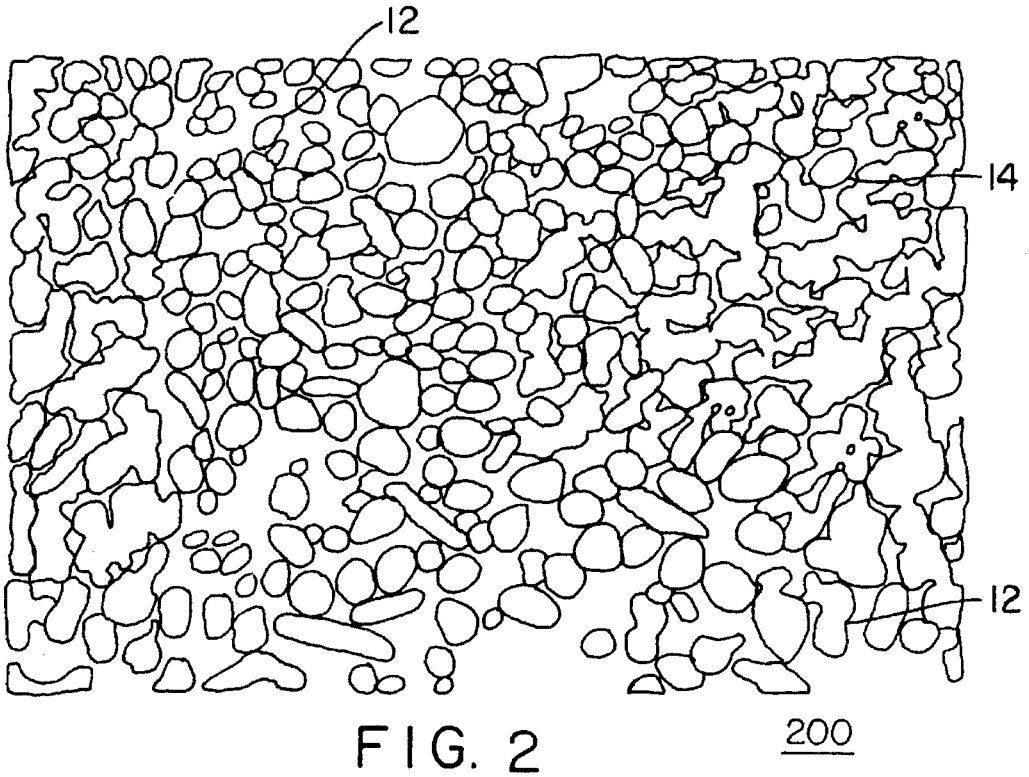
FIG. 2 is a top plan view of the calcium carbonate abrasive showing a medium grade of material at 30× magnification.
Figure 3:
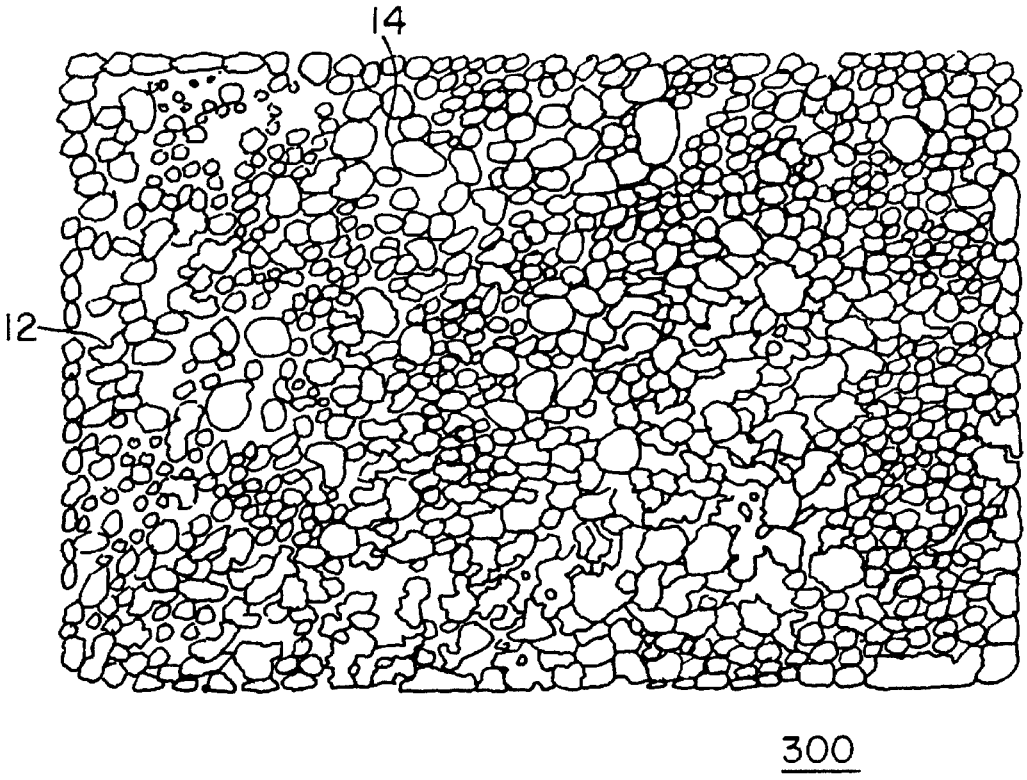
FIG. 3 is a top plan view of the calcium carbonate abrasive showing a fine grade of material at 30× magnification.

The calcium carbonate 10 of the present invention used in abrasive-blasting operations has at least three particle size gradations being a coarse grade 100, a medium grade 200, and a fine grade 300. The particle shape is generally irregular with curved edges 12 and rounded edges 14 for the medium and fine grades 200 and 300; while the coarse grade 100 material has sharp angular edges 16 as well as the curved and rounded edges 12 and 14 in its particle shape. These aforementioned gradations of coarse, medium, and fine 100, 200, and 300 are depicted in FIGS. 1, 2, and 3.

The coarse grade 100 has an average bulk density of 104 lbs/ft$^3$, in the range of 103 to 105 lbs/ft$^3$, where 90% of the particle sized materials are retained on the 100 MESH screen size. The average density for coarse grade 100 is 181 lbs/ft$^3$, having a range of 179 to 183 lbs/ft$^3$. The average particle size for the coarse grade 10 is a diameter of 40 MESH, which is equivalent to 0.0165" or 0.42 mm or 420 microns, having a size range of 4 MESH, which is equivalent to 0.187" or 4.76 mm to 200 MESH, which is equivalent to 0.0029" or 0.074 mm or 74 microns in particle size diameters.

The medium grade 200 has an average bulk density of 99 lbs/ft$^3$, in the range of 98 to 100 lbs/ft$^3$, where 90% of the particle sized materials are retained on the 115 MESH screen size. The average density for medium grade 200 is 177 lbs/ft$^3$, having a range of 174 to 179 lbs/ft$^3$. The average particle size for the medium grade 200 is a diameter of 50 MESH, which is equivalent to 0.0117" or 0.297 mm or 297 microns, having a size range of 12 MESH, which is equivalent to 0.0661" or 1.68 mm to 200 MESH, which is equivalent to 0.0029" or 0.074 mm or 74 microns in particle size diameters.

The fine grade 300 has an average bulk density of 93 lbs/ft$^3$, in the range of 91 to 95 lbs/ft$^3$, where 90% of the particle sized materials are retained on the 140 MESH screen size. The average density for fine grade 300 is 172 lbs/ft$^3$, having a range of 169 to 174 lbs/ft$^3$. The average particle size for the fine grade 300 is a diameter of 70 MESH, which is equivalent to 0.0083" or 0.210 mm or 210 microns, having a size range of 50 MESH, which is equivalent to 0.0117" or 0.297 mm or 297 microns to 200 MESH, which is equivalent to 0.0029" or 0.074 mm or 74 microns in particle size diameters.

Figure 4:
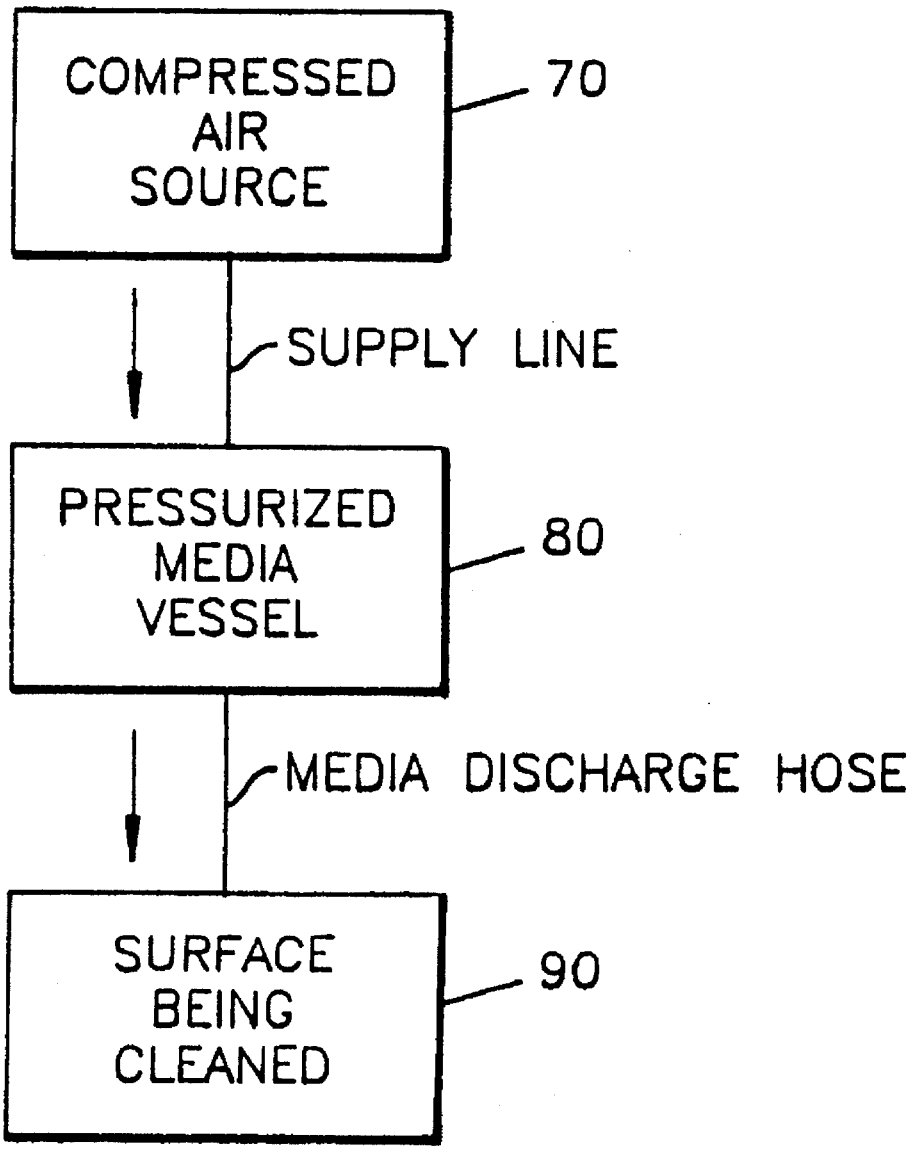
(PRIOR ART) FIG. 4
FIG. 4 is a schematic block diagram showing the operational flow chart of a conventional abrasive blast system.
Figure 5:
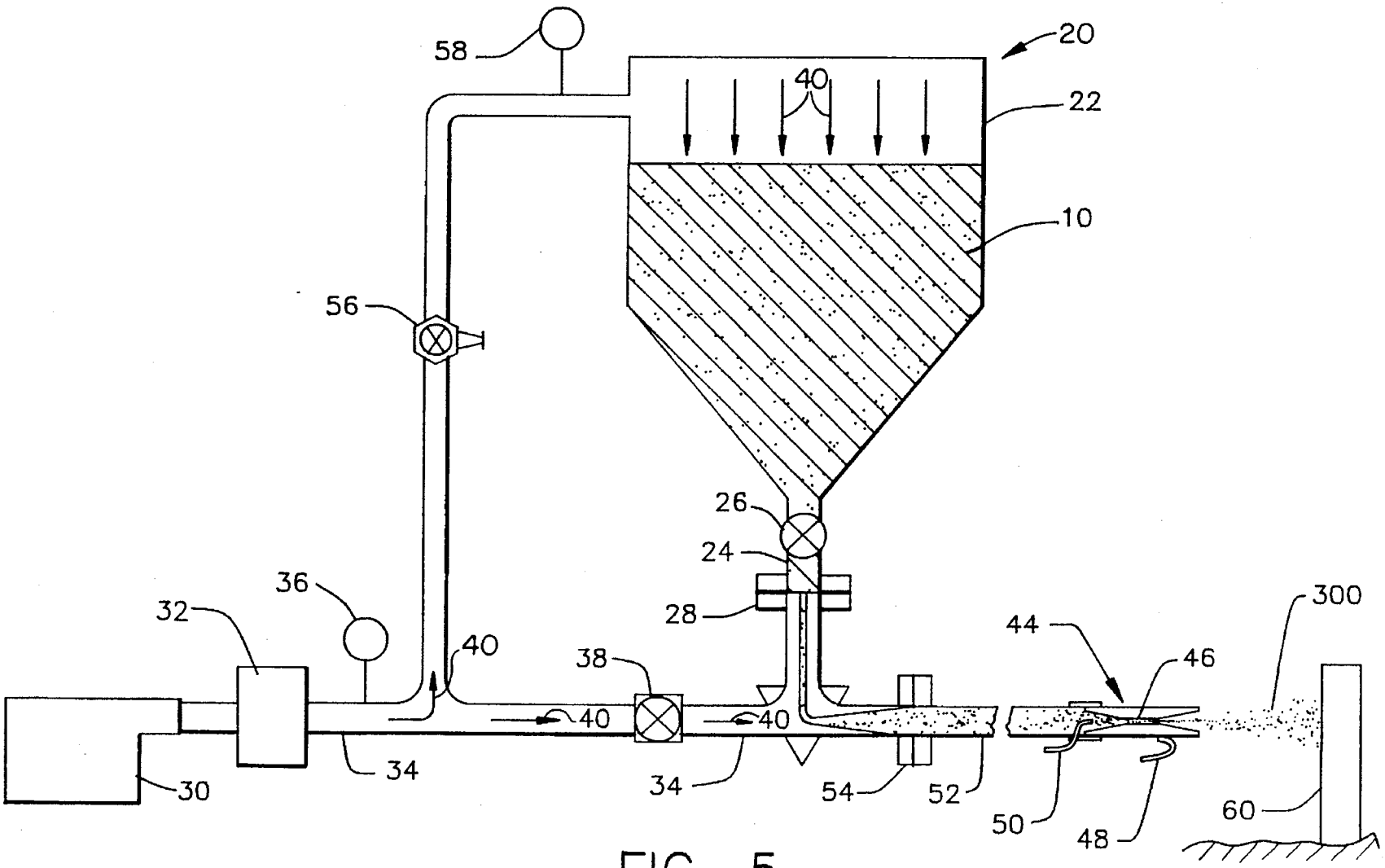
FIG. 5 is a diagrammatic side elevational view illustrating a general abrasive-blasting system in conjunction with the calcium carbonate of the present invention.

The invention will be described in detail by reference to FIGS. 1 through 5, showing the use of a standard commercially-available blast-apparatus system 20 using the calcium carbonate abrasive material 10. As depicted in FIG. 5, the blast apparatus system 20 includes a blast pot 22, partially filled with an appropriate grade of calcium carbonate abrasive material 10 for blasting a given surface area. The blast pot 22 includes a media exit line 24 having a media exit valve 26, where the calcium carbonate 10 blast media is flowing through a media orifice plate 28 which restricts the flow of calcium carbonate 10 to a desired flow rate. An air pipeline 34 is connected to a source of high-volume pressurized air 30 having outlet dryer component 32, an inlet air-pressure monitoring gauge 36, and an inlet air-regulating valve 38. The air valve 38 is an automatically-operated ON/OFF valve that activates the air flow 40 to the nozzle 44 and the opening and closing of media cutoff valve 26. The air valve 38 also maintains the desired nozzle pressure for an appropriate amount of spray of the calcium carbonate 10 blasting media onto a given surface 60. The blast nozzle 44 includes an orifice insert 46 which is sized to a proper throat diameter, depending upon the grade of calcium carbonate 10 used; a nozzle handle 48 for activating the pressurized air flow 40 and calcium carbonate blasting media 10; and a water injection line 50 which injects water into the nozzle 44 for the control of dust and cooling of the nozzle head to dissipate any heat buildup.

The nozzle 44 is attached to a conveying hose 52 having a hose disconnect 54 from the air pipeline 34. The blast pot pressure regulator 56 is monitored by pressure gauge 58 which provides for a higher pressure than the pressure used in the conveying hose 52. This pressure differential provides for the moving of the calcium carbonate media 10 to move through the orifice plate 28.

In operation, as depicted by FIG. 4, the abrasive-blasting system 20 provides for operational steps 70, 80, and 90 for using calcium carbonate abrasive media 10 and includes the following steps:

a) connecting of air line 34 and conveying hose 52 to blasting pot 22;

b) filling of blasting pot 22 with a specific grade 100, 200, or 300 of calcium carbonate 10;

c) adjusting of media flow valve 26 (depending upon media grade used) to a specific flow rate;

d) selecting of a nozzle orifice 46 size for the media grade 100, 200, or 300 used;

e) pressurizing of blasting pot 22 by an air compressor 30;

f) holding of nozzle 44 an approximate distance of 14" to 16" away from surface 60 being cleaned;

g) activating blasting pot 22 by depressing handle 48 on nozzle 44 of media discharge hose 52;

h) moving the spraying nozzle 44 across the surface 60 being cleaned, with an approximate 40% to 50% overlap (dependent on the type of cleaning required, profile, and surface being cleaned); and i) readjusting of media flow rate as required for surface 60 being cleaned.

Each gradation of the calcium carbonate 10 abrasive blasting media is such that the coarse grade 100, medium grade 200, and fine grade 300 has a specific operational function. The operational use is dependent upon the following factors: the actual type of surface to be cleaned; the degree of surface cleanliness (surface preparation required) needed for the profile of surface required; the blasting flow rate, air-pressure setting, and orifice size of nozzle; and the grade of blasting media being used.

Typical surfaces to be cleaned using calcium carbonate 10 would include steel, iron, aluminum, ceramic, brick, concrete, stone, wood, plastic, fiberglass, and the like.

The degree of surface cleanliness is measured by standard specifications of surface finishes which would include the following:

a) a brush-off blast cleaned surface;

b) a commercial blast cleaned surface;

c) a near-white metal blast cleaned surface; and d) a white metal blast cleaned surface.

These standards are defined by the National Association of Corrosion Engineers (USA) and are defined as follows:

STANDARDS OF SURFACE FINISH a) Brush-Off

A brush-off blast cleaned surface shall be free of all visible oil, grease, dirt, dust, loose mill scale, loose rust, and loose paint. Tightly adherent mill scale, rust, and paint may remain on the surface. Mill scale, rust, and paint are considered tightly adherent if they cannot be removed by lifting with a dull putty knife.

b) Commercial

A commercial blast cleaned surface shall be free of all visible oil, grease, dirt, dust, mill scale, rust, paint, oxides, corrosion products, and other foreign matter, except for staining. Staining shall be limited to no more than 33% of each square inch of surface area and may consist of light shadows, slight streaks, or minor discolorations caused by stains of rust, stains of mill scale, or stains of previously-applied paint. Slight residues of rust and paint may also be left in the bottoms of pits if the original surface is pitted.

c) Near-White Metal

A near-white metal blast cleaned surface shall be free of all visible oil, grease, dirt, dust, mill scale, rust, paint, oxides, corrosion products, and any other foreign matter, except for staining. Staining shall be limited to no more than 5% of each square inch of surface area and may consist of light shadows, slight streaks, or minor discolorations caused by stains of rust, stains of mill scale, or stains of previously-applied paint.

d) White Metal

A white metal blast cleaned surface shall be free of all visible oil, grease, dirt, dust, mill scale, rust, paint, oxides, corrosion products, and other foreign matter.

The blasting flow rate when using calcium carbonate 10 is in the preferred range of 85 to 1600 lbs/hr, having a general range of 40 to 4600 lbs/hr of product usage with the air volume flow rate being in the preferred range of 15 to 250 cfm, having a general range of 8 to 750 cfm. The nozzle air pressure settings for calcium carbonate used for abrasive blasting is in the preferred range of 70 to 100 psig, having a general range of 30 to 120 psig. The aforementioned criteria of blasting flow rate, air volume flow rate, and nozzle air pressure are all dependent upon the grade of calcium carbonate 10 used for a specific nozzle orifice diameter 46.

When using the coarse grade 100 of calcium carbonate 10, the blast flow rate is in the preferred range of 90 to 1600 lbs/hr, with a general range of 700 to 4600 lbs/hr. The air volume flow rate for coarse grade is in the preferred range of 150 to 250 cfm. The nozzle air pressure is in the preferred range of 75 to 100 psig, having a general range of 30 to 120 psig. These flow rates and nozzle air pressures include orifice sizes 46 in the range of ⅜" to ¾".

In using the medium grade 200 of calcium carbonate 10, the blast flow rate is in the preferred range of 350 to 500 lbs/hr, with a general range of 175 to 810 lbs/hr. The air volume flow rate for medium grade 200 is in the preferred range of 60 to 85 cfm, having a general range of 35 to 140 cfm. The nozzle air pressure is in the preferred range of 70 to 100 psig, having a general range of 30 to 110 psig. The above flow rates and nozzle air pressures include orifice sizes 46 of ¼" to 5/16".

In using the fine grade 300 of calcium carbonate 10, the blast flow rate is in the preferred range of 85 to 115 lbs/hr, with a general range of 40 to 265 lbs/hr. The air volume flow rate for fine grade 300 is in the preferred range of 15 to 20 cfm, having a general range of 8 to 40 cfm. The nozzle air pressure is in the preferred range of 70 to 100 psig, having a general range of 30 to 105 psig. The above flow rates and nozzle air pressures include orifice sizes 46 of ⅛" to 3/16".

Nozzle selection is also dependent upon the grade of calcium carbonate being used, along with the type of surface to be blasted, air pressure; working conditions, degree of surface penetration, and preparation required, and the volume of air available. The size of nozzle orifice 46 (with the smallest opening through which air laden with calcium carbonate 10 is transmitted) is the single-most critical factor in the correct selection of a nozzle orifice for the particular grade of coarse 100, medium 200, and fine 300 of calcium carbonate 10 being used. The diameter of orifice 46 determines how much calcium carbonate 10 will be consumed and how much air pressure 36 and air volume 40 are needed. Also, the selection of the orifice 46 diameter is guided by the available air supply from compressor 30. Orifice size 46 for the nozzle 44 ranges in sizes from ⅛", 3/16", ¼", 5/16", ⅜", 7/16", ½", ⅝", and ¾" for all grades of calcium carbonate to be used. Nozzle 44 selection using the coarse grade 100 of calcium carbonate 10 would use orifice sizings 46 of ⅜", 7/16", ½", ⅝", and ¾".

Nozzle 44 selection using the medium grade 200 of calcium carbonate 10 would use orifice sizings 46 of ¼" and 5/16". Nozzle 44 selection using the fine grade 300 of calcium carbonate 10 would use orifice sizings 46 of ⅛" and 3/16".

The length of nozzle 44 is also a consideration, which depends upon accessibility and nature of the surface 60 being cleaned and the diameter of orifice 46. A short-barrel nozzle **44*a* is used for blast applications, where the operator must work within 12" of the surface 60. A long-barrel nozzle 44*b* is used for high production projects and other blast applications, where the operator can blast more than 12" from the surface 60** being cleaned.

In actual laboratory conditions, a certified lab performed tests using the coarse grade 100, medium grade 200, and fine grade 300 of calcium carbonate 10, where three 4"×6" hot rolled steel panels were to be cleaned with each grade of calcium carbonate abrasive 10. These panels were evaluated to determine the profile obtained (penetration to surface) and the amount of embedment. Also, each grade of calcium carbonate 10 was screened to give a precise MESH screening. Embedment is determined by placing a grid over the blast cleaned area in which the grid contains 100 squares, such that each square that contains an embedded particle is counted. The results of the aforementioned tests are given in Table 1 below.

Tables 2, 3, and 4 below represent the various gradations of calcium carbonate 10 being the coarse, medium, and fine grades 100, 200, and 300, respectively. These Tables 2, 3, and 4 summarize the product characteristics of each grade of calcium carbonate used, where the criteria are U.S. Standard Screen Size (MESH) specifications, bulk density, MOH hardness, nozzle sizes, blasting flow rates, air-volume flow rates; nozzle air pressure, and the recommended uses and applications for each of the grades of calcium carbonate 10 being used.

TABLE 1

| | Coarse Abrasive No. 100 | Medium Abrasive No. 200 | Fine Abrasive No. 300 |
|---|---|---|---|
| 1. MESH/Sieve Screening | | | |
| 6 | 9.9 | 0 | 0 |
| 8 | 23.3 | 0 | 0 |
| 12 | 28.8 | 0 | 0 |
| 16 | 29.5 | 1.3 | <1 |
| 20 | 6.0 | 2.9 | <1 |
| 30 | <1 | 1.5 | <1 |
| 40 | <1 | 7.0 | <1 |
| 50 | <1 | 22.4 | 4.2 |
| 70 | <1 | 22.1 | 19.9 |
| 100 | <1 | 21.5 | 31.4 |
| 140 | <1 | 13.3 | 24.5 |

TABLE 1-continued

| | Coarse Abrasive No. 100 | Medium Abrasive No. 200 | Fine Abrasive No. 300 |
|---|---|---|---|
| 100 | <1 | 2.6 | 13.6 |
| smaller than 200 | <1 | <1 | 3.1 |
| size | 6/20 | 30/100 | 50/140 |
| 2. MOH hardness | 4.25 | 4.25 | 4.25 |
| 3. Nozzle diameter in inches | ⅜ | ¼ | ¼ |
| Test No. 1 | | | |
| 4. Nozzle air pressure in psig | 100 | 100 | 100 |
| 5. Profile in mils | 3.6 | 1.1 | 0.8 |
| 6. Embedment (% particles embedded in plate) | 100% | 89% | 94% |
| Test No. 2 | | | |
| 7. Nozzle air pressure in psig | 75 | 80 | 80 |
| 8. Profile in mils | 1.7 | 1.2 | 0.9 |
| 9. Embedment (% particles embedded in plate) | 100% | 85% | 97% |

TABLE 2

PRODUCT DATA SHEET FOR COARSE GRADE 100 OF CALCIUM CARBONATE 10

| Product Characteristic | Product Specification |
|---|---|
| A. U.S. standard screen size (MESH) specification | |
| 1. Where 90% of the screened materials are retained | 100 mesh |
| 2. For the average particle size diameter | 400 mesh: which is equivalent to 0.0165", 0.42 mm, or 426 microns |
| 3. For the particle range of diameter | 4 MESH to 200 MESH: 3/16", 4.76 mm, or 4760 microns 0.029", 0.074 mm, or 74 microns |
| $B_1$. Bulk density in lbs/ft$^3$ | |
| 1. Average | 104 |
| 2. Range | 103 to 105 |
| $B_2$. Bulk density in lbs/ft$^3$ | |
| 1. Average | 181 |
| 2. Range | 179 to 183 |
| C. MOH hardness | |
| 1. Average | 4.25 |
| 2. Range | 4.00 to 4.50 |
| D. Nozzle sizes to be used in inches | ⅜", 7/16", ½", ⅝", and/or ¾" |
| E. Blasting flow rates in lbs/hr | |
| 1. Preferred range | 900 to 1600 |
| 2. General range | 700 to 4600 |
| F. Air volume flow rate in ft$^3$/min | |
| 1. Preferred range | 150 to 250 |
| 2. General range | 75 to 750 |
| G. Air pressure in psig of nozzle | |
| 1. Preferred range | 75 to 100 |

TABLE 2-continued

| PRODUCT DATA SHEET FOR COARSE GRADE 100 OF CALCIUM CARBONATE 10 | |
|---|---|
| Product Characteristic | Product Specification |
| 2. General range | 30 to 120 |
| H. Profile | 2.0 to 4.0 mils |
| I. Recommended uses and applications for specified gradation | This coarse grade is used for tough blasting projects, when a rough profile is required or for special applications; for example, such as heavy rust, thick and tough coatings of paint, lacquer, varnish, etc., mastics, ships and barges, tanks and tank linings, scaling or stripping action, pre-metalizing, or concrete |

TABLE 3

| PRODUCT DATA SHEET FOR MEDIUM GRADE 200 OF CALCIUM CARBONATE 10 | |
|---|---|
| Product Characteristic | Product Specification |
| A. U.S. standard screen size (MESH) specification | |
| 1. Where 90% of the screened materials are retained | 115 mesh |
| 2. For the average particle size diameter | 500 mesh: which is equivalent to 0.0117", 0.297 mm, or 297 microns in particle size diameter |
| 3. For the particle range of diameter | 12 MESH to 200 MESH: 0.0661", 1.68 mm, or 1680 microns 0.0020", 0.074 mm, or 74 microns |
| $B_1$. Bulk density in lbs/ft$^3$ | |
| 1. Average | 99 |
| 2. Range | 98 to 100 |
| $B_2$. Bulk density in lbs/ft$^3$ | |
| 1. Average | 177 |
| 2. Range | 174 to 179 |
| C. MOH hardness | |
| 1. Average | 4.00 |
| 2. Range | 3.90 to 4.30 |
| D. Nozzle sizes to be used in inches | ¼", 5/16" |
| E. Blasting flow rates in lbs/hr | |
| 1. Preferred range | 350 to 500 |
| 2. General range | 175 to 810 |
| F. Air volume flow rate in ft$^3$/min | |
| 1. Preferred range | 60 to 85 |
| 2. General range | 35 to 140 |
| G. Air pressure in psig of nozzle | |
| 1. Preferred range | 70 to 100 |
| 2. General range | 30 to 110 |
| H. Profile | 1.0 to 2.0 mils |
| I. Recommended uses and applications for specified gradation | This medium grade is used for general-purpose repair and maintenance blasting. For example, the removal or stripping of rust and paint, general purpose use, ships, tanks and vats, aggregate exposure, structural steel, mill scale, and bridges. |

TABLE 3-continued

| PRODUCT DATA SHEET FOR MEDIUM GRADE 200 OF CALCIUM CARBONATE 10 | |
|---|---|
| Product Characteristic | Product Specification |

TABLE 4

| PRODUCT DATA SHEET FOR FINE GRADE 300 OF CALCIUM CARBONATE 10 | |
|---|---|
| Product Characteristic | Product Specification |
| A. U.S. standard screen size (MESH) specification | |
| 1. Where 90% of the screened materials are retained | 140 mesh |
| 2. For the average particle size diameter | 70 mesh: which is equivalent to 0.0083", 0.210 mm, or 210 microns in particle size diameter |
| 3. For the particle range of diameter | 50 MESH to 200 MESH: 0.017", 0.247 mm, or 29 microns to 0.0029", 0.074 mm, or 74 microns |
| $B_1$. Bulk density in lbs/ft$^3$ | |
| 1. Average | 93 |
| 2. Range | 91 to 95 |
| $B_2$. Bulk density in lbs/ft$^3$ | |
| 1. Average | 172 |
| 2. Range | 169 to 174 |
| C. MOH hardness | |
| 1. Average | 3.80 |
| 2. Range | 3.50 to 3.95 |
| D. Nozzle sizes to be used in inches | ⅛", 3/16" |
| E. Blasting flow rates in lbs/hr | |
| 1. Preferred range | 85 to 115 |
| 2. General range | 40 to 265 |
| F. Air volume flow rate in ft$^3$/min | |
| 1. Preferred range | 15 to 20 |
| 2. General range | 8 to 40 |
| G. Air pressure in psig of nozzle | |
| 1. Preferred range | 70 to 100 |
| 2. General range | 30 to 105 |
| H. Profile | 0.5 to 1.0 mils |
| I. Recommended uses and applications for specified gradation | This fine grade is used for fine cleaning and deburring of delicate surfaces to effect a smooth surface and/or finish, for new construction, and for special maintenance applications requiring a reduced profile. For example, the light removal of paint, varnish, rust, and the like, mill scale, light aggregate exposure, trucks, bridges, cabinets, electric motors, masonry of all kinds, and high-pressure water-blast systems. |

ADVANTAGES OF THE PRESENT INVENTION

Accordingly, the primary advantage of the present invention is that it provides a method of employing an abrasive material, such as soft calcium carbonate ($CaCO^3$) to be used in heavy-duty to light abrasive-blasting of solid surfaces.

Another advantage of the present invention is that it employs a calcium carbonate abrasive material having a coarse, medium, or fine grade.

Another advantage of the present invention is that the coarse grade of calcium carbonate may be used for heavy-duty and tough blasting projects where a rough profile is needed for applications to remove heavy rust, thick and tough coatings of paint, lacquer, or varnish on large structures, ships, barges, tanks, and on concrete or steel structures, and the like.

Another advantage of the present invention is that the medium grade of calcium carbonate may be used for general purpose repair and maintenance blasting for the removal or stripping of rust and paint on ships, tanks, vats, aggregate exposure, structural steel, bridges, concrete, and the like.

Another advantage of the present invention is that the fine grade of calcium carbonate may be used for fine cleaning and deburring of delicate surfaces, to provide a smooth surface and/or finish, for new construction and for special maintenance applications requiring a small profile reduction where there is a light removal of paint, varnish, rust, and the like on electric motors, aircraft, fiberglass boats, cabinets, masonry, bridges, trucks, and the like.

Another advantage of the present invention is that it provides for a reduced blasting time because the calcium carbonate particles are clean and dense and have rounded and curved surface shapes which provide a faster cleaning action.

Another advantage of the present invention is that it provides for lower handling costs because of calcium carbonate's high-bulk density, which permits the blasting pot to be loaded with more abrasive material.

Another advantage of the present invention is that it provides for a reduced clean-up time due to low dusting, minimum ricochet, and less material to pick up because less is required to do the project.

Another advantage of the present invention is that the calcium carbonate provides for good flow properties, as it contains no lumps or slivers which are commonly found in boiler slags and low-quality silica sands.

Another advantage of the present invention is that it provides for an abrasive material that is soft, with the ability to clean a surface with a minimal amount of a surface layer being abraded.

Another advantage of the present invention is that it provides for an abrasive material that is environmentally safe, wherein the calcium carbonate in use is non-toxic and is free of heavy metals, silica and iron particles and, in general, provides a minimal amount of dust production when in use.

Still another advantage of the present invention is that it provides for an abrasive material and method of use that is worker friendly, such that the user does not need a full air respirator with an air tank but only needs a simple nose and mouth face mask.

A still further advantage of the present invention is that it provides for an abrasive material and method of use that has no health hazards connected with it when in use.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method for blast cleaning a solid surface using an abrasive composition of calcium carbonate, wherein the abrasive-blasting operation uses blasting apparatus including a blasting pot, a blasting hose and spray nozzle connected to the blasting pot, an air compressor and compressor air lines connected to the blasting pot, blasting hose, and spray nozzle, comprising the steps of:

a) filling said blasting pot with an abrasive composition of a coarse grade of calcium carbonate, wherein the calcium carbonate has the following properties: a diameter in the range of 4 MESH to 200 MESH and 90% of the particles are retained on a screen of 100 MESH; a bulk density in the range of 103 to 105 lbs/ft$^3$ and a density in the range of 179 to 183 lbs/ft$^3$; a MOH hardness in the range of 4.00 to 4.50; and said calcium carbonate being at least 96.0% by weight of the composition;

b) selecting a blasting spray nozzle having an orifice size in the range of ⅜" to ¾";

c) adjusting a media flow valve connected to said blasting pot to set a blasting flow rate in the range of 700 to 4600 lbs/hr;

d) setting the air pressure on said compressor air line connected to said spray nozzle to a pressure in the range of 30 to 120 psig;

e) setting the air volume flow rate on said compressor air line to a rate in the range of 75 to 750 cfm;

f) holding said spray nozzle a distance of 6" to 24" away from the surface to be cleaned; and g) moving said spray nozzle across the surface to be cleaned.

2. The method of claim 1, wherein the diameter of said calcium carbonate particles has an average size of 420 microns.

3. The method of claim 1, wherein the average bulk density is 104 lbs/ft$^3$.

4. The method of claim 1, wherein the average density is 181 lbs/ft$^3$.

5. The method of claim 1, wherein the average MOH hardness is 4.25.

6. The method of claim 1, wherein the selected nozzle size is ½" for use in cleaning steel.

7. The method of claim 1, wherein the step of adjusting includes setting a blasting flow rate having a range of 900 to 1600 lbs/hr.

8. The method of claim 1, wherein the step of setting the air pressure includes setting a spray nozzle pressure having a range of 75 to 100 psig.

9. The method of claim 1, wherein the step of setting the air volume flow rate includes an air volume flow rate having a range of 150 to 250 cfm.

10. The method of claim 1, wherein the surface being cleaned has a profile in the range of 2.0 to 4.0 mils.

11. A method for blast cleaning a solid surface using an abrasive composition of calcium carbonate, wherein the abrasive-blasting operation uses blasting apparatus including a blasting pot, a blasting hose and spray nozzle connected to the blasting pot, an air compressor and compressor air lines connected to the blasting pot, and blasting hose and spray nozzle, comprising the steps of:

a) filling said blasting pot with an abrasive composition of a medium grade of calcium carbonate, wherein the calcium carbonate has the following properties: a diameter in the range of 12 MESH to 200 MESH and 90% of the particles are retained on a screen of 115 MESH; a bulk density in the range of 98 to 100 lbs/ft$^3$ and a density in the range of 174 to 179 lbs/ft$^3$; a MOH hardness in the range of 3.90 to 4.30; and said calcium carbonate being at least 96.0% by weight of the composition;

b) selecting a blasting spray nozzle having an orifice size in the range of ¼" to 5/16";

c) adjusting a media flow valve connected to said blasting pot to set a blasting flow rate in the range of 175 to 810 lbs/hr;

d) setting the air pressure on said compressor air line connected to said spray nozzle to a pressure in the range of 30 to 110 psig;

e) setting the air volume flow rate on said compressor air line to a rate in the range of 35 to 140 cfm;

f) holding said spray nozzle a distance of 6" to 24" away from the surface to be cleaned; and g) moving said spray nozzle across the surface to be cleaned.

12. The method of claim 11, wherein the diameter of said calcium carbonate particles has an average size of 420 microns.

13. The method of claim 11, wherein the average bulk density is 99 lbs/ft$^3$.

14. The method of claim 11, wherein the average density is 177 lbs/ft$^3$.

15. The method of claim 11, wherein the average MOH hardness is 4.00.

16. The method of claim 11, wherein the selected nozzle size is ¼" for use in cleaning steel.

17. The method of claim 11, wherein the step of adjusting includes setting a blasting flow rate having a range of 350 to 500 lbs/hr.

18. The method of claim 11, wherein the step of setting the air pressure includes setting a spray nozzle pressure having a range of 70 to 100 psig.

19. The method of claim 11, wherein the step of setting the air volume flow rate includes an air volume flow rate having a range of 60 to 85 cfm.

20. The method of claim 11, wherein the surface being cleaned has a profile in the range of 1.0 to 2.0 mils.

21. A method for blast cleaning a solid surface using an abrasive composition of calcium carbonate, wherein the abrasive-blasting operation uses blasting apparatus including a blasting pot, a blasting hose and spray nozzle connected to the blasting pot, an air compressor and compressor air lines connected to the blasting pot, and blasting hose and spray nozzle, comprising the steps of:

a) filling said blasting pot with an abrasive composition of a fine grade of calcium carbonate, wherein the calcium carbonate has the following properties: a diameter in the range of 50 MESH to 200 MESH and 90% of the particles are retained on a screen of 140 MESH; a bulk density in the range of 91 to 95 lbs/ft$^3$ and a density in the range of 169 to 174 lbs/ft$^3$; a MOH hardness in the range of 3.50 to 3.95; and said calcium carbonate being at least 96.0% by weight of the composition;

b) selecting a blasting spray nozzle having an orifice size in the range of ⅛" to 3/16";

c) adjusting a media flow valve connected to said blasting pot to set a blasting flow rate in the range of 40 to 265 lbs/hr;

d) setting the air pressure on said compressor air line connected to said spray nozzle to a pressure in the range of 30 to 105 psig;

e) setting the air volume flow rate on said compressor air line to a rate in the range of 8 to 40 cfm;

f) holding said spray nozzle a distance of 6" to 24" away from the surface to be cleaned; and g) moving said spray nozzle across the surface to be cleaned.

22. The method of claim 21, wherein the diameter of said calcium carbonate particles has an average size of 210 microns.

23. The method of claim 21, wherein the average bulk density is 93 lbs/ft$^3$.

24. The method of claim 21, wherein the average density is 172 lbs/ft$^3$.

25. The method of claim 21, wherein the average MOH hardness is 3.80.

26. The method of claim 21, wherein the selected nozzle size is ⅛" for use in cleaning steel.

27. The method of claim 21, wherein the step of adjusting includes setting a blasting flow rate having a range of 85 to 115 lbs/hr.

28. The method of claim 21, wherein the step of setting the air pressure includes setting a spray nozzle pressure having a range of 70 to 100 psig.

29. The method of claim 21, wherein the step of setting the air volume flow rate includes an air volume flow rate having a range of 15 to 20 cfm.

30. The method of claim 21, wherein the surface being cleaned has a profile in the range of 0.5 to 1.0 mils.

* * * * *